United States Patent [19]

Sweeny

[11] Patent Number: 5,027,102

[45] Date of Patent: Jun. 25, 1991

[54] SCORING SYSTEM FOR ATHLETIC EVENTS

[76] Inventor: Edward J. Sweeny, Rte. 4, Airport Park, Petersburg, Va. 23803

[21] Appl. No.: 407,649

[22] Filed: Sep. 15, 1989

[51] Int. Cl.[5] ..... G08B 23/00

[52] U.S. Cl. ..... 340/323 R; 273/DIG. 26; 364/411

[58] Field of Search ..... 340/323 R; 273/1 E, 273/1 ES; 364/410, 411, 412; 434/247

[56] References Cited

U.S. PATENT DOCUMENTS

| | | | |
|---|---|---|---|
| 432,694 | 7/1890 | Chappel . | |
| 1,922,517 | 8/1933 | Amory | 177/384 |
| 2,669,389 | 2/1954 | Mesi et al. | 235/92 |
| 3,202,803 | 8/1965 | Markstrom | 235/92 |
| 3,580,581 | 5/1971 | Raven | 273/138 A |
| 3,727,213 | 4/1973 | Kurtenbach | 340/323 R |
| 3,737,889 | 6/1973 | Sweeny | 340/323 |
| 4,183,056 | 1/1980 | Evans et al. | 340/323 R |
| 4,479,181 | 10/1984 | Hannah | 340/323 R |
| 4,496,148 | 1/1985 | Morstain et al. | 273/1 E |
| 4,763,284 | 8/1988 | Carlin | 340/323 R |
| 4,775,937 | 10/1988 | Bell | 364/412 |

FOREIGN PATENT DOCUMENTS

| | | |
|---|---|---|
| 819910 | 8/1969 | Canada . |
| 61427 | 10/1928 | New Zealand . |

OTHER PUBLICATIONS

Soctron brochure, "Introducing an Exciting New Dimension to Boxing", 5-72.

*Primary Examiner*—Joseph A. Orsino
*Assistant Examiner*—Brent A. Swarthout
*Attorney, Agent, or Firm*—Reese Taylor

[57] ABSTRACT

A scoring system for sporting contests includes positioning an appropriate number of judges about the site of the contest and providing each with a signalling device which is connected to a display which superimposes the points awarded on a picture of the contest. The picture is generated by a television camera positioned so as to present a view of the contest comparable to that of each judge. The signalling device for each judge is also connected to a computer which records and totals the scores thus provided and produces a total score. Variations of the system provide differential scores for the contestants for each increment of the contest.

16 Claims, 3 Drawing Sheets

SCORING SYSTEM FOR ATHLETIC EVENTS

BACKGROUND OF THE INVENTION

This invention relates, in general, to the scoring of athletic contests and relates, in particular, to a system for both improving the quality of the scoring of the event and enhancing the enjoyment thereof on the part of the audience.

The invention will be illustrated and described in the context of the sport of boxing, but it will also be noted that the principles hereof have applicability to other sporting events, such as kick boxing, wrestling, etc., wherein judges award points based upon the performance of the participants, as contrasted to athletic events wherein points are awarded automatically upon the achievement of certain objective goals, such as crossing a goal line. Accordingly, while reference will be made throughout to boxing as the contest being scored, for simplicity of explanation, the invention is by no means intended to be so limited in its scope.

DESCRIPTION OF THE PRIOR ART

Applicant's earlier U.S. Pat. No. 3,737,889 disclosed a method and apparatus for scoring athletic events, such as boxing contests, wherein each official was provided with an individual panel upon which performance points were recordable. The points scored by each individual judge or official were then transmitted to a master console for cumulative progressive scoring of the event during its progress. The collected points were then flashed on a scoreboard, visible to the audience, so that they might be made progressively aware of the standing of the contestants.

This was an improvement over the then existing prior art, wherein the three judges or two judges and a referee normally assigned to evaluate a boxing match simply recorded their decisions manually at the end of each round and the official scorecards were then totalled at the end of the event. The obvious difficulty previous to Applicant's earlier invention was that the audience had no really accurate knowledge of the true standings of the contestants until the contest ended.

Of course, in addition to being disadvantageous from the standpoint of the audience, there were other difficulties, such as, for example, the fact that the judges could conceivably be, even unintentionally, influenced by crowd reaction and crowd noise. That problem was also solved in the system disclosed in U.S. Pat. No. 3,737,889 by making provision for isolating the judges from these possibly distracting or prejudicial influences.

In addition to simply enhancing the interest of spectators by making them currently aware of the relative standing of the contestants as the bout progressed, this advance also added to the attraction of the event for those who had wagered on the outcome.

The patent prior art also includes other examples of electro-mechanical or electronic scoring systems for scoring contests such as can be seen in Chappell U.S. Pat. No. 432,694; Amory U.S. Pat. No. 1,922,517; Mesi U.S. Pat. No. 2,669,389; Markstrom U.S. Pat. No. 3,202,803 and Morstain U.S. Pat. No. 4,496,148. Also, the patent prior art discloses various devices for compiling information related to the gambling aspect of sporting contests as can be seen in New Zealand Patent 61,427; Canadian Patent 819,910 and Raven U.S. Pat. No. 3,580,581.

Accordingly, while the systems of the above-referred to Sweeny patent as well as the other prior art referred to were presumably effective for the purposes for which they were designed, it has been found that still further improvements can be made to further enhance the quality of the judging and the enjoyment of the audience.

Specifically, it is believed to be desirable to be able to monitor and control the quality of the performance of the individual official or judge so that it can be evaluated following the contest. It is, therefore, believed desirable to provide some means by which the precise event which triggered the award of points by the judge can be objectively reviewed and evaluated.

It is also well-known that wagering of various types is often desired by the audience observing contests of this type, and it is believed desirable to provide visual means for evaluating the outcome of the fight, such as, for example, following each individual round so as to enhance the wagering environment.

It is also believed desirable in some circumstances to provide for a parimutual betting arrangement so that, in addition to wagering on each round or other segment of the contest, wagering can be conducted on the final ultimate outcome and various other aspects of the contest.

SUMMARY OF THE INVENTION

It is, accordingly then, a principal object of this invention to provide a computerized system for obtaining a record of the scoring by each judge or other official at the athletic event and to provide for a display of that scoring to the audience as the contest progresses.

It is a further object of this invention to provide a system whereby a visual record can be kept of the scoring by each judge or other official for subsequent review to insure quality in the judging and scoring.

It is a still further object of this invention to provide means for recording and perhaps printing the scoring results by judge.

It is still a further object of this invention to provide a system whereby wagering can be conducted on a round-by-round basis as the contest progresses.

It is a still further object of this invention to provide a system to facilitate pari-mutual betting on the ultimate outcome of the contest.

These and other objects of the invention will become more apparent upon a reading of the following brief specification considered and interpreted in view of the accompanying drawings.

BRIEF DESCRIPTION OF THE PREFERRED EMBODIMENTS

Before describing the preferred embodiments of the invention, it will be noted that, in essence, the drawings are schematic only and it is believed apparent that a plurality of known electronic components will be employed in the system. The specific design and structure of the known components has not been illustrated herein since such is believed to be well within the skill of one with ordinary skill in this art. It is believed that the combination of elements into an overall system provides the inventive concept disclosed, described and claimed herein.

Figure 1:
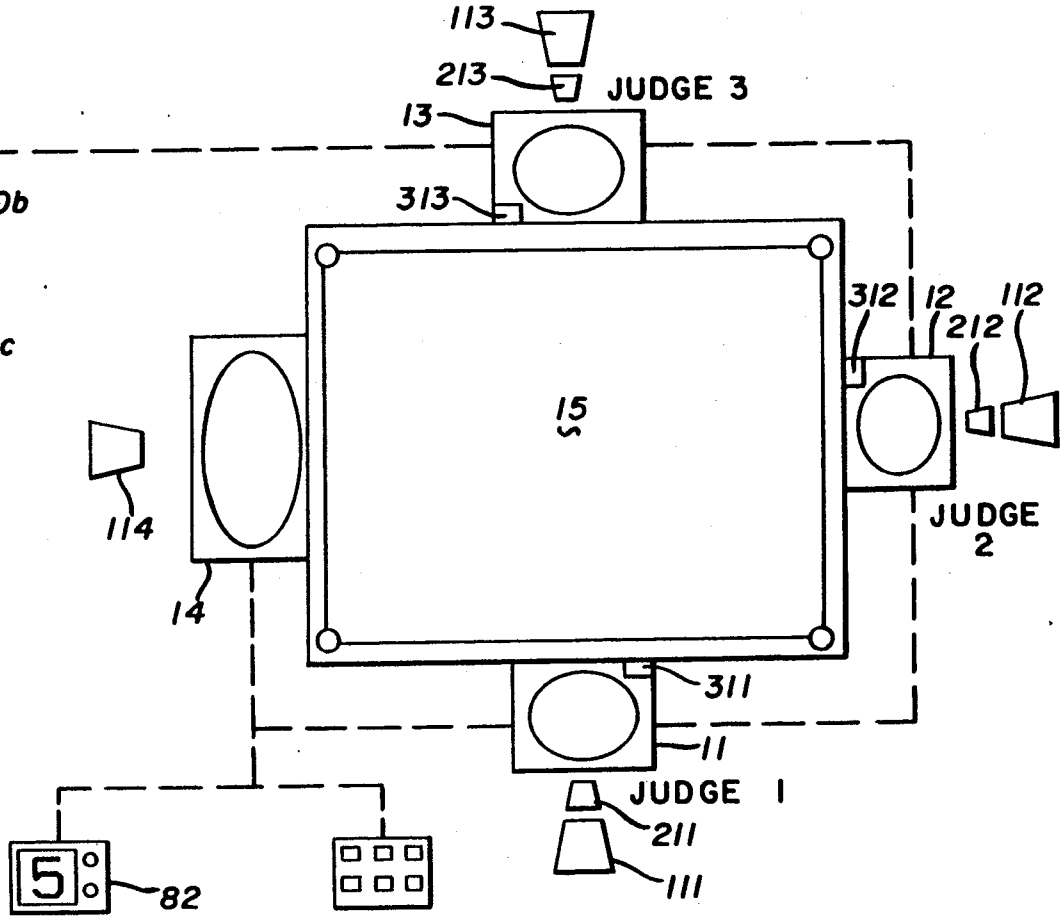
FIG. 1 is a schematic view showing the ring and scoreboard arrangement of the system.

In its broadest sense, what is illustrated is a computerized system for scoring boxing contests. Referring to FIG. 1 of the drawings, the system is comprised of a scoreboard 10 located in view of the spectators, three judging/scoring booths 11, 12 and 13 located on three sides of the ring 15 and the master control station 14, located on the fourth side of the ring. An input/output board is provided at each station, as indicated by the numerals 11*a*, 12*a*, 13*a* and 14*a*.

The three judges sit in the booths 11, 12 and 13, which are preferably soundproof, and may optionally wear headsets. Stereo music or white noise may be fed into the headsets to further mask crowd noise and influence if desired. Microphones (not shown) are disposed at each station and used to communicate with the master control operator at station 14 should problems with the system develop or if special instructions or questions are necessary.

The scoreboard 10, which is positioned so as to be visible to the audience, displays relevant information including scores for each contestant as at 10*a* and 10*b*, the round as at 10*c* and the elapsed time in the current round as at 10*d*.

Figure 3:
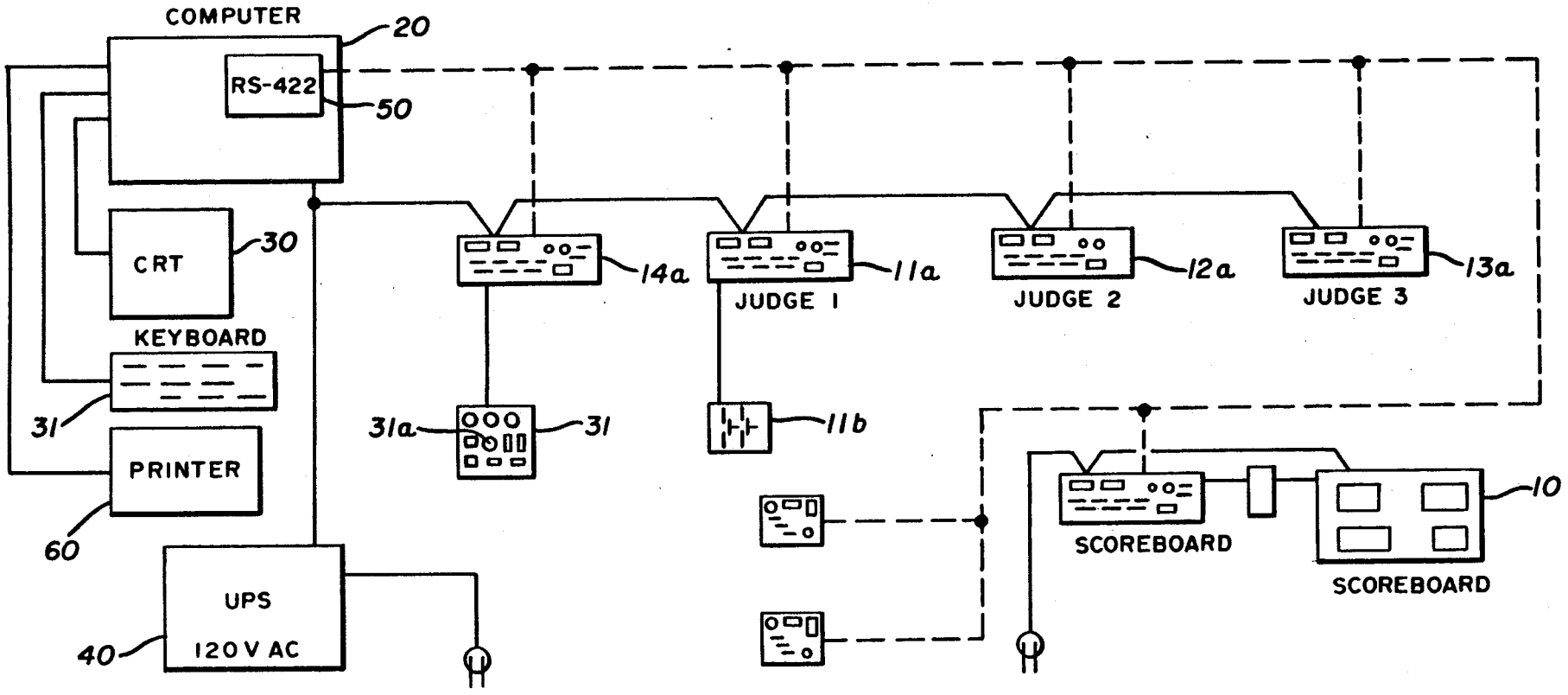
FIG. 3 is a schematic view of the overall system.
Figure 4:
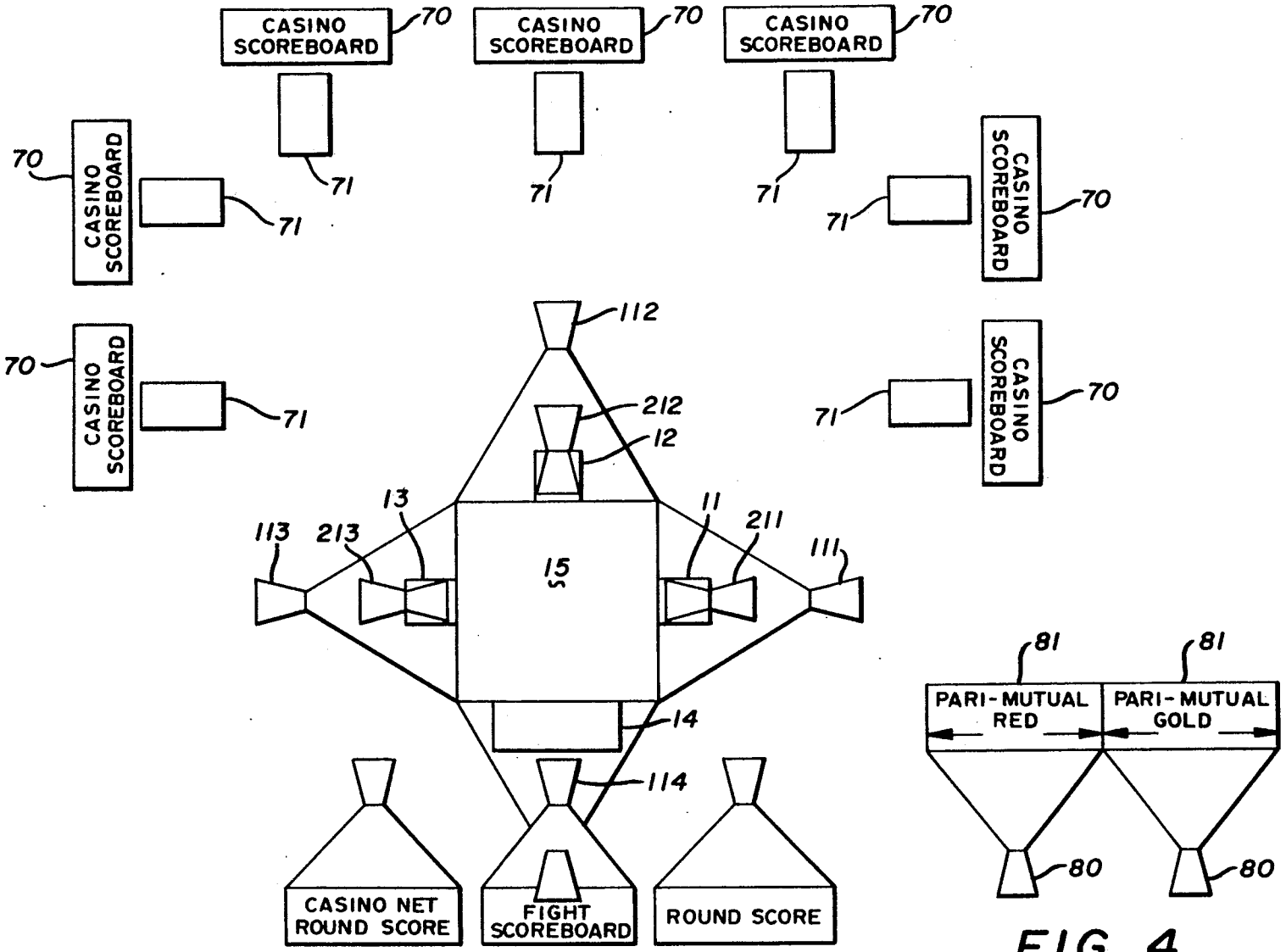
FIG. 4 is a schematic view of the system adapted for pari-mutual betting.

It is contemplated that the boxers will wear color-coded trunks, such as, for example, red and gold, and that the judges will score the fight with momentary push-button switches that are color-coded to correspond to the boxer's trunks. Exemplary push-button switches are shown in FIG. 3 at 11*b* with it being understood that the arrangement is typical and would be duplicated for the other two judges. A gold switch held in one hand represents the boxer in gold trunks and a red switch in the other hand represents the boxer in red trunks. A single push of the switch scores a point for that boxer which represents a clean punch landed in a legal area of the opponent. A switch pushed twice represents an extremely hard blow to the opponent, scoring two points for that boxer. Input from these switches is locked out at the end of each round and enabled at the beginning of the next round, although a slight delay of a few seconds may be provided at the end of the round to permit recording the final blows.

Figure 2:
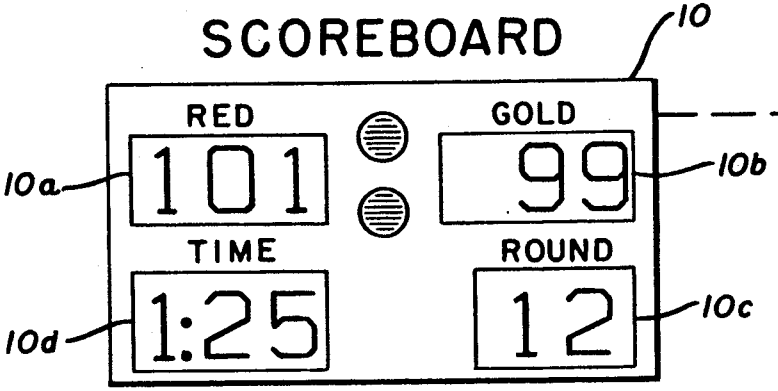
FIG. 2 is a schematic view of the master control station operator interface.
Figure 2:
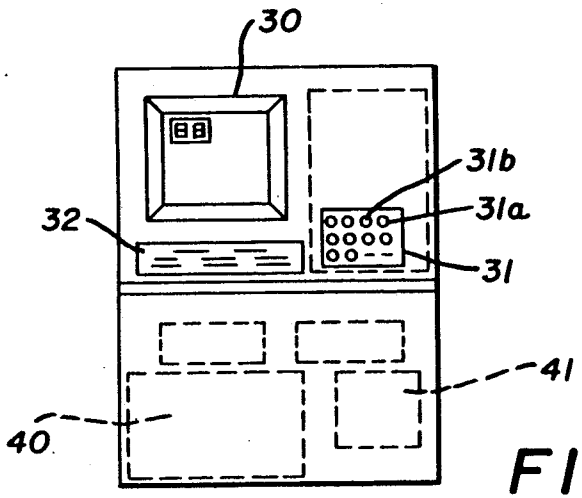

The points awarded by each judge are accumulated in the computer 20 by individual counters and are displayed on the master control CRT screen 30 (see also FIG. 2). The accumulated points are also stored on a suitable storage medium for future analysis along with the individual boxer's scores. Scoring of each boxer is accomplished by dividing the total number of switch pulses from all three judges by three in the form of the invention illustrated. In other words, for each three pulses received for a given boxer, a point is added to his total score, although a different formula may, in certain circumstances, be employed. These weighted scores are displayed on the scoreboard 10 in appropriate red or gold boxes 10*a* and 10*b* as well as the CRT screen 30 at the master control station 14. It should be noted that the actual input from each individual judge is displayed only on the master control screen 30, since this information is primarily important for the quality control aspect of the system. The counters are capable of storing and displaying up to 999 points for each boxer.

The master control operator may also add or subtract points from either boxer's score as necessary for bonus points or for penalty points with keyboard 32. For example, five points are added to a boxer's score if he officially knocks down his opponent as signalled by the referee. And if a boxer commits some illegal action, the referee may signal that one or more points be subtracted from his score. The addition or subtraction of points is accomplished from the master control station 14 with switches on the master control console 31.

The computer 20 will maintain all current information, should a power failure occur, long enough to move the data onto a non-volatile storage medium or, in other words, to allow the computer to dump the information onto such a medium. This will be accomplished with an uninterruptible power supply (UPS) 40. The UPS 40 will maintain the computer and scoring functions for up to five (5) minutes, excluding the scoreboard 10. The current information will be updated on the scoreboard by the computer with complete score and time once full power is restored to the system.

Further functions of the computer 20 include the official timing of both the rounds and rest periods and counting of the rounds. The round counter shows zero or blank when the fight begins and advances to 1 at the beginning of Round 1 and continues to show Round 1 until the beginning of Round 2, at which time it advances. It will stop counting at the end of a preset number of rounds and can be reset at the master control station 14. The round/test timer is a decrementing timer which alternately counts round periods and rest periods both of which can be preset as desired. This timer will be reinitialized when the round counter is reset. It is also possible to provide a hold switch at the master control station 14 to stop the timer if, for example, the referee signals a time out.

The timing and round count will be displayed on the scoreboard at 10*c* and 10*d*. The beginning and ending of rounds are signalled by a bell, and a buzzer is sounded ten (10) seconds before the end of the rest period in conventional fashion. The number of rounds and time per round can be preprogrammed to accommodate various rules for various jurisdictions, e.g., three minute or two minute rounds, etc. These variables can also be adjusted as necessary at fight time.

As noted, the scoreboard 10 will display total accumulated points for each boxer, the current round, and the countdown time for the round or rest period. A countdown timer will also run continuously after the start of the first round, alternately displaying the round time or the rest time remaining. The timer stops at the end of the last round. If the fight is officially stopped, the master control operator can also stop the timer manually.

A sound system 41, separate from the computer scoring system, is used to mask crowd noise from the scorers and for communication to and from the master control operator. The judges wear headsets and are in a soundproof booth. Stereo music or white noise may be fed into the headphones to further mask crowd noise and influence if desired. The master control operator or judges may use the microphones to alert each other should problems with the scoring system arise.

As previously noted, not only is it desired to monitor the points awarded by each judge, it is desired to be able to associate the awarding of points by each judge with the actual actions of the contestants which lead to the award of the points.

With that in mind and referring again to FIG. 1 of the drawings, it will be seen that the basic boxing "ring", which is actually square, is generally indicated by the numeral 15 and has associated with it four video cameras of known types and generally indicated by the numerals 111, 112, 113 and 114.

These cameras are disposed about the four sides of the ring commonly used in boxing, wrestling and other similar athletic contests, although, of course, the precise configuration of the locus of the athletic contest would depend on the contest and might affect the location of the cameras. As noted at the outset however, the present invention is only being described primarily with relation to boxing for ease of description.

Accordingly, the disposition of the cameras 111, 112, 113 and 114 is such that, in general, a view from nearly all possible perspectives is provided by the combination of cameras. In particular, at least the views available to each judge are duplicated by the various cameras.

Three supplemental cameras 211, 212, and 213 are also provided. It will be assumed, again, that a boxing contest is involved and judging stations 11, 12 and 13 will be disposed on three sides of the ring. These judging stations will essentially consist of an isolation type booth, as described in Applicant's earlier U.S. Pat. No. 3,737,889. Each judge is provided with the already described momentary push-button switches held in each hand with each switch representing one of the individual contestants. As previously noted, a push of the switch will score a point for that contestant and the switch may be pushed twice for an extremely hard blow, etc. In any event, associated with each judge is an individual judges' scoreboard, as indicated by the numerals 311, 312 and 313 of FIG. 1. While not available to the audience, the score recorded by the judge for a particular act of the contestant will be displayed on the boards 311, 312 and 313.

The supplemental cameras 211, 212 and 213 will film the display on the boards 311, 312 and 313 and this score will be superimposed on the picture being taken by the cameras 111, 112 and 113 in known fashion. In this way, for each individual judge, a tape, film or other suitable storage media will be prepared so as to reflect the action which took place in the ring 15 and also, superimposed on the tape, film or other media will be the points awarded by each individual judge at the time the action took place.

Accordingly, it is a relatively simple matter at a subsequent time to review the tapes, films or other media to evaluate the merits of the judge's decision as to the points awarded for any particular act by the competitors.

As has been noted and as can be seen from FIGS. 1, 2 and 3, the individual judge's stations 11, 12 and 13 are also electronically connected to a master control station 14. This master control station is then connected to a main fight scoreboard 10 which is visible to the audience and displays the cumulative points for each contestant on the board, presumably at the end of each round. In this fashion, the audience is apprised, as the contest progresses, of the relative standing of the contestants and, not necessarily incidentally, the contestants are also apprised of their standings.

The system described thus far is believed to be a definite improvement over the prior art in that, in addition to keeping the audience apprised of the progress of the contest, so far as the points are concerned, it clearly provides an improved quality control tool for evaluating the performance of the judges or officials.

The invention also lends itself to a further modification which enhances wagering on the contest.

To that end, it is contemplated that a plurality of casino or wagering stations will be provided, each with a scoreboard designated by the numeral 70. These are "slave" scoreboards and they display the score for each individual round on the scroeboards 70,70. It should be noted that only one camera 71 is illustrated, but one would be associated with each scoreboard 70.

It is thus possible, through the computer 30, to set the score at zero prior to the outset of each round or other segment of the contest on scoreboards 70,70.

In that fashion, as points are awarded by the judges and accumulated through the computer, the standings will be reflected, as the round progresses, on the scoreboards.

While many methods of wagering are possible, one is to add and subtract points as they are accumulated and the wagering would be on the basis of, first, which contestant is expected to win the round and, second, on the basis of the point spread or differential.

In that regard, for example, the contestants would start out with zero points at the outset of the round and then, as points were awarded to the red contestant, for example, they would be added to his total on a plus or minus basis. For example, if the first contestant were to score two points, followed by the second contestant scoring one, the scoreboard would reflect one point for the first contestant.

It is also contemplated that a pari-mutual betting arrangement can be provided by using the cameras 80,80 and the pari-mutual boards 81,81. The pari-mutual concept would involve the running computation of odds by a computer, the display of those odds, etc.

As previously noted, no great detail has been set forth with regard to the electronic components of the system since they will be reasonably known to those skilled in the art. However, certain exemplary components will now be described.

By way of example only then, the computer used for the system may be a personal computer that has been industrialized to withstand harsh environments and rough handling. The computer is based on the industry standard PC Bus architecture and communicates with the scoreboard and scoring stations over an RS-422 serial communication link 50. The high noise immunity of RS-422 allows use of simple dual twisted-pair wiring for the network even in the most severe environments. The baud rate of the network will be in the range of 300 to 19,200.

All functions of the system will be handled by the computer 20, except for the mechanical counters used by the judges. The scoring inputs from the judges and bonus or penalty points from the master control operator will be accumulated, totalled, and displayed by the computer on the scoreboard 10 and on the master control CRT display 30. Display at the master control station 14 will optionally be on a color CRT screen simulating the actual scoreboard display described above.

As noted, the round counter **10*c* will contain zero before a fight begins and will advance to one (1) at the sound of the bell for the first round. In operating the system, the fight is started by the master control operator pressing the "Start" push-button 31*a* on his control board 31. After that, the counter 10*c* will advance one increment of one at the beginning of each round and the round counter will stop counting at the end of the last round. The number of rounds, as well as the length of each round, will be preprogrammed into the computer prior to the beginning of the fight. The round counter is reset by the computer 20** as part of the normal operation in preparation for the next fight.

The bell and buzzer functions will also be controlled by the computer based on the status of the round/rest timer. At the beginning and end of each round, an output will be turned on by the computer 30 to sound the bell. Likewise, the rest timer will turn on an output 10 seconds before the end of the rest period to sound the buzzer.

The uninterruptible power system 40 will be included in the overall control system to maintain the computer and scoring functions for up to five (5) minutes. The scoreboard and any remote displays or functions will not be maintained by the UPS 40. However, the scoreboard and remote displays will be refreshed with the current scores and times as soon as full power is restored.

Input/output signals to and from the computer will be handled by circuit boards originally designed for industrial control applications and adapted for use in the system. These remote I/O stations 11*a*, 12*a*, 13*a* and 14*a* communicate with the host computer 30 over an RS-422 serial communications link 50. Each I/O unit is assigned a unique address, making it possible to communicate with up to 245 units over the single RS-422 link.

The network will provide error-free operation through the use of a simple secure protocol. All data and command messages exchanged between the host computer 30 and the I/O units 11*a*, 12*a*, 13*a* and 14*a* are represented as printable ASCII characters. This network approach with its simple protocol allows scoring input (individual scoring by the judges) and output (the scoreboard display) at remote locations without running large bundles of wire from the booths and scoreboard back to the master control station.

A modem can also be included in the network to communicate with I/O units over a radio link or telephone lines for longer distances.

Provisions will be incorporated into the system design and software/programming to give remote display of the six individual scoring counters of the three scoring judges. These displays can be used for performance evaluation of judges and for training new judges. These displays can be tied into the network allowing them to be placed remote from the computer CPU. These displays can be incorporated into a video tape of the fight for ultimate quality control over the scoring of a fight. The displays will also be color-coded for the fighters and will be three-digit displays capable of showing up to 999 points/punches for each fighter.

A further provision to be included is for remote differential point displays 82 that will show the point difference between the two fighters and which one is ahead during a round. The difference count starts over at the beginning of each new round and can be used for casino applications of the system. These displays, too, can be tied into the network to allow remote viewing of the differential score between the two fighters. These displays will be two-digit displays capable of showing up to 99 points difference between the fighter's scores.

A printer 60 may also be included to print the fight results. The report will contain information from each round as well as the total points for each boxer. All the available information from the fight may be stored on disks for future reference, analysis, and for evaluation of judges and fighters. This information can be made available to coaches, trainers, commissions, etc., for training and evaluation assistance.

While a full and complete description of the invention has been set forth in accordance with the dictates of the Patent Statutes, it should be understood that modifications can be restored to without departing from the spirit hereof or the scope of the appended claims.

What is claimed is:

1. A scoring system for athletic contests wherein one or more judges are positioned about the locus of the contest, comprising:

(a) signalling means positioned adjacent each judge;

(b) a computer connected to said signalling means for recording and totalling the input from said signalling means and establishing a score for each contestant therefrom;

(c) audience observable display means connected to said computer for displaying the score for each contestant;

(d) a first non-audience observable display means for displaying the input from each signalling means;

(e) a second non-audience observable display means disposed adjacent each judge for recording and displaying the score recorded by each judge;

(f) a first camera disposed adjacent each judge and positioned so as to record the action of the contest from substantially the same perspective as the judge;

(g) a second camera disposed adjacent each judge and positioned so as to record the data recorded on said second non-audience observable display means; and (h) means for superimposing the image from said second camera on the image from said first camera.

2. The system of claim 1 wherein one or more audience observable slave scoreboards are connected to said computer for displaying scoring data therefrom.

3. The system of claim 2 wherein means are provided for zeroing the score displayed on said slave scoreboards prior to the beginning of each segment of the contest.

4. The system of claim 1 wherein pari-mutual odds calculating means are included in said computer; and a second audience observable display means is connected to said computer for display of the data provided thereby.

5. The system of claim 1 wherein isolation means are positioned adjacent each judge.

6. The system of claim 5 wherein said isolation means include a soundproof booth.

7. The system of claim 5 or 6 wherein said isolation means include headsets for providing sound deadening noise to each judge.

8. The system of claim 1 wherein said audience observable display means include round and time displays.

9. The system of claim 8 wherein a decrementing timer is connected to said round and timer displays and said computer.

10. The system of claim 1 wherein said signalling means include momentary push-buttons for each contestant for each judge; said computer including means for enabling and disenabling each push-button in a predetermined pattern.

11. The system of claim 1 wherein means for recording the input from each said signalling means are provided in said computer.

12. The system of claim 1 wherein a printer is connected to said computer.

13. The system of claim 10 wherein a master control station is connected to said computer; and master signalling means are provided at said master control station for increasing or decreasing the score derived from the input from said signalling means positioned adjacent each judge.

14. A scoring system for athletic contests wherein one or more judges are positioned about the locus of the contest, comprising:

(a) signalling means positioned adjacent each judge;
(b) a computer connected to said signalling means for recording and totalling the input from said signalling means and establishing a score for each contestant therefrom;
(c) audience observable display means connected to said computer for displaying the score for each contestant;
(d) a first non-audience observable display means for displaying the input from each signalling means;
(e) a second non-audience observable display means disposed adjacent each judge for recording and displaying the score recorded by each judge;
(f) a first camera disposed adjacent each judge and positioned so as to record the action of the contest from substantially the same perspective as the judge;
(g) a second camera disposed adjacent each judge and positioned so as to record the data recorded on said second non-audience observable display means;
(h) means for superimposing the image from said second camera on the image from said first camera; and
(i) means for recording and calculating wagering data.

15. The system of claim 14 wherein said means for recording and calculating wagering data include pari-mutual odds calculating means included in said computer; and at least one pari-mutual, audience observable display-means is connected to said computer for display of the pari-mutual odds calculated thereby.

16. The system of claim 14 or 15 wherein said means for recording and calculating wagering data include differential score calculating means included in said computer; and at least one additional audience observable display means is connected to said computer for display of the differential score for each increment of the contest.

* * * * *